US011497375B2

(12) United States Patent
Hotz et al.

(10) Patent No.: US 11,497,375 B2
(45) Date of Patent: Nov. 15, 2022

(54) WASHING CONTAINER, DOMESTIC DISHWASHER, AND METHOD

(71) Applicant: BSH Hausgeräte GmbH, Munich (DE)

(72) Inventors: Dieter Hotz, Dischingen (DE); Alaimo Angelelli, Fabriano-AN (IT); Johann Schabert, Holzheim (DE); Martin Becker, Haunsheim (DE); Manfred Herb, Syrgenstein (DE)

(73) Assignee: BSH Hausgeräte GmbH, Munich (DE)

( * ) Notice: Subject to any disclaimer, the term of this patent is extended or adjusted under 35 U.S.C. 154(b) by 474 days.

(21) Appl. No.: 16/605,228

(22) PCT Filed: May 9, 2018

(86) PCT No.: PCT/EP2018/062028
§ 371 (c)(1),
(2) Date: Oct. 15, 2019

(87) PCT Pub. No.: WO2018/219614
PCT Pub. Date: Dec. 6, 2018

(65) Prior Publication Data

US 2021/0137346 A1 May 13, 2021

(30) Foreign Application Priority Data

May 31, 2017 (DE) ..... 10 2017 209 234.3

(51) Int. Cl.
*A47L 15/42* (2006.01)

(52) U.S. Cl.
CPC ..... *A47L 15/4246* (2013.01)

(58) Field of Classification Search
None
See application file for complete search history.

(56) References Cited

U.S. PATENT DOCUMENTS 5,299,586 A 4/1994 Jordan et al.
2020/0196829 A1* 6/2020 Budzynski ..... A47L 15/4246

FOREIGN PATENT DOCUMENTS

DE 102009001260 A1 9/2010
EP 0541846 A1 5/1993
WO 2008125472 A1 10/2008
WO 2017032779 A1 3/2017

OTHER PUBLICATIONS

International Search Report PCT/EP2018/062028 dated Aug. 17, 2018.

* cited by examiner

*Primary Examiner* — Levon J Shahinian
(74) *Attorney, Agent, or Firm* — Michael E. Tschupp; Andre Pallapies; Brandon G. Braun

(57) ABSTRACT

A dishwasher cavity for a household dishwasher includes a bottom panel having a bottom portion, and a U-shaped dishwasher cavity jacket arranged on the bottom panel and fixedly connected thereto, with the bottom panel and the dishwasher cavity jacket configured to form an attachment flange that encircles the dishwasher cavity. A back panel is attached to the bottom panel and to the dishwasher cavity jacket via the attachment flange. The bottom panel includes a stamped step, which faces in a direction of a top panel of the dishwasher cavity jacket and protrudes out of the bottom portion of the bottom panel, with the attachment flange having a part formed on the stamped step.

17 Claims, 5 Drawing Sheets

WASHING CONTAINER, DOMESTIC DISHWASHER, AND METHOD

CROSS-REFERENCES TO RELATED APPLICATIONS

This application is the U.S. National Stage of International Application No. PCT/EP2018/062028, filed May 9, 2018, which designated the United States and has been published as International Publication No. WO 2018/219614 A1 and which claims the priority of German Patent Application, Serial No. 10 2017 209 234.3, filed May 31, 2017, pursuant to 35 U.S.C. 119(a)-(d).

BACKGROUND OF THE INVENTION

The present invention relates to a dishwasher cavity for a household dishwasher, to a household dishwasher having a dishwasher cavity of this type, and to a method for producing a dishwasher cavity of this type.

A dishwasher for the most part has one dishwasher cavity that is formed from multiple sheet metal portions that are connected to one another. The sheet metal portions may be by way of example welded to one another or connected to one another by means of a folding-over procedure. By way of example, the dishwasher cavity comprises a bottom, one side panel respectively being attached to each side of the bottom, and a back panel that closes off the dishwasher cavity at the back. The back panel is connected to the dishwasher cavity with the aid of an attachment flange that is provided on the dishwasher cavity.

Document DE 10 2015 216 228 A1 discloses a dishwasher having a dishwasher cavity, which comprises multiple panel parts and which is provided with a loading orifice on the front face for loading the items to be washed, said loading orifice may be able to be closed at least for periods of time by means of a cavity door, wherein the right-hand side panel, the top panel and the left-hand side panel form a metal hood that in the extended state forms a preferably flat press part and subsequently has been bent into a U-shape, wherein a trough-shaped bottom made from metal is a deep-drawn part that is manufactured from a preferably austenitic steel and wherein the metal back panel that is placed at the back against the metal hood and against the trough-shaped bottom made from metal is configured as a preferably flat press part.

BRIEF SUMMARY OF THE INVENTION

On the basis of this background, one object of the present invention is to provide an improved dishwasher cavity for a household dishwasher.

Accordingly, a dishwasher cavity for a household dishwasher is proposed. The dishwasher cavity comprises a bottom panel, a back panel and a U-shaped dishwasher cavity jacket that is arranged on the bottom panel and is fixedly connected thereto, wherein the bottom panel and the dishwasher cavity jacket have an attachment flange that encircles the dishwasher cavity so as to attach the back panel to the bottom panel and to the dishwasher cavity jacket, and wherein the bottom panel comprises a stamped step, which faces the direction of a top panel of the dishwasher cavity jacket and protrudes out of a bottom portion of the bottom panel, a part of the attachment flange being attached to said stamped step.

By virtue of the fact that a part of the attachment flange is already formed as one on the bottom panel, it is possible for the attachment flange to be already formed as one in part in the tool for producing the bottom panel. As a consequence, this part of the attachment flange may be produced very precisely, as a result of which the sealing arrangement between the back panel and the attachment flange is reliably ensured. Furthermore, the stamped step that is provided on the bottom panel makes it possible for the washing water to run off from the back panel away in the direction of a pump sump of the household dishwasher.

The fact that the dishwasher cavity jacket is U-shaped is to be understood to mean that said dishwasher cavity jacket comprises a first side panel, a second side panel and a top panel of the dishwasher cavity that is arranged between the first side panel and the second side panel. The dishwasher cavity jacket is in this case arranged and placed on the bottom panel in such a manner that the U-shaped geometric shape of the dishwasher cavity jacket is closed in the upward direction and open in the downward direction. In other words, the U-shaped geometric shape is not lying on the bottom panel but rather is arranged in a vertical position thereon. The bottom panel is preferably configured from a different steel material to that of the dishwasher cavity jacket. By way of example, it is possible to use for the dishwasher cavity jacket a more cost-efficient material than for the bottom panel. In particular, a flange portion that forms the previously mentioned part of the attachment flange is formed as one on the stamped step. This flange portion is preferably already formed as one thereon during the procedure of producing the bottom panel, by way of example with the aid of a deep-drawn method.

In accordance with one embodiment, the stamped step comprises a first step portion, which is arranged at an angle of inclination with respect to the bottom portion of the bottom panel, and a second step portion, which is arranged parallel to the bottom portion of the bottom panel, wherein the first step portion is arranged between the bottom portion and the second step portion.

It is possible with the aid of this geometric shape to create sufficient space for a welding tool to connect the attachment flange to the back panel. The angle of inclination is by way of example 10 to 40°, more preferably 20 to 30°, more preferably 25°. The stamped step comprises furthermore the flange portion that has already been mentioned previously and that is arranged in particular in a vertical manner with respect to the second step portion.

In accordance with a further embodiment, the stamped step extends as far as into a side panel portion of the bottom panel.

The bottom panel preferably comprises two side panel portions, wherein the stamped step extends into each of the side panel portions.

In accordance with a further embodiment, the stamped step extends with a radius into the side panel portion of the bottom panel.

In particular, both the first step portion and also the second step portion respectively extend with a radius into the side panel portion of the bottom panel. As a consequence, it is possible to realize an additional reinforcement of the side panel portions.

In accordance with a further embodiment, the side panel portion of the bottom panel comprises a formed portion that extends beyond the stamped step and is folded so as to form the attachment flange.

A formed portion of this type is preferably provided on each of the side panel portions. Each formed portion is formed during the procedure of producing the attachment flange.

In accordance with a further embodiment, prior to the formed portion being folded, said formed portion is arranged in a vertical manner with respect to the part of the attachment flange that is formed as one on the stamped step.

In particular, prior to the formed portion being folded, said formed portion is arranged in a vertical manner with respect to the flange portion of the stamped step.

In accordance with a further embodiment, after the formed portion has been folded, said formed portion is arranged parallel to the part of the attachment flange that is formed as one on the stamped step.

In particular, the part of the attachment flange, which is formed as one on the stamped step, namely the flange portion thereof, and the respective formed portion form a common plane.

In accordance with a further embodiment, the bottom panel comprises a first side panel portion, a second side panel portion and the bottom portion that is arranged between the first side panel portion and the second side panel portion.

In particular, the bottom panel has a U-shaped cross-section. In particular, the dishwasher cavity jacket is fixedly connected both to the first side panel portion and also to the second side panel portion. By way of example, the dishwasher cavity jacket is connected with the aid of a folded connection to the first side panel portion and the second side panel portion respectively.

In accordance with a further embodiment, the dishwasher cavity jacket comprises a first side panel that is fixedly connected to the bottom panel, a second side panel that is fixedly connected to the bottom panel and the top panel that is arranged between the first side panel and the second side panel.

In particular, the dishwasher cavity jacket is placed on the bottom panel in such a manner that the top panel is arranged opposite the bottom panel. In other words, the dishwasher cavity jacket is arranged with its U-shaped geometric shape in a vertical position with respect to the bottom panel and not lying on said bottom panel.

In accordance with a further embodiment, the attachment flange is folded in a vertical manner with respect to the dishwasher cavity jacket and the bottom portion of the bottom panel.

No further shaping of the stamped step, and in particular of the flange portion of the stamped step, is performed during the procedure of producing the attachment flange. In other words, in order to form the attachment flange, only the dishwasher cavity jacket, in particular a flange portion of the dishwasher cavity jacket, and the formed portions of the bottom panel are shaped.

In accordance with a further embodiment, the back panel is welded, in particular spot-welded, to the attachment flange.

A sealing element, by way of example a polyurethane seal, may be provided between the back panel and the attachment flange.

Moreover, a household dishwasher having a dishwasher cavity of this type is proposed.

It is possible to attach a door to the dishwasher cavity, said door being able to pivot about a pivot axis in order to open and close the dishwasher cavity. It is possible to provide in the dishwasher cavity a multiplicity of, by way of example three, devices for receiving items to be washed, said receiving devices being arranged one above the other.

Moreover, a method for producing a dishwasher cavity for a household dishwasher is proposed. The method comprises the steps: provide a bottom panel, a back panel and a U-shaped dishwasher cavity jacket, wherein the bottom panel comprises a stamped step that protrudes from a bottom portion of said bottom panel; connect the dishwasher cavity jacket to the bottom panel in such a manner that the stamped step extends in the direction of a top panel of the dishwasher cavity jacket; produce an attachment flange that encircles the dishwasher cavity jacket and the bottom panel, wherein a part of the attachment flange is formed by the stamped step; and connect the back panel to the attachment flange.

In particular, the dishwasher cavity jacket is connected to the bottom panel with the aid of a folded connection. The dishwasher cavity jacket is placed on the bottom panel in such a manner that the stamped step extends in the direction of the top panel of the dishwasher cavity jacket. During the procedure of providing the bottom panel, the stamped step is formed thereon as one with the folded flange portion. No further shaping of the flange portion of the stamped step is subsequently performed during the procedure of producing the attachment flange. During the procedure of producing the attachment flange, in particular only the flange portion of the dishwasher cavity jacket and the formed portions of the bottom panel are folded.

In accordance with a further embodiment, during the procedure of providing the bottom panel, the stamped step is formed thereon together with the part of the attachment flange that is formed by the stamped step.

For this purpose, in particular the stamped step is already pre-formed with the flange portion in the tool that is provided for producing the bottom panel.

In accordance with a further embodiment, a formed portion of a side panel portion of the bottom panel is folded during the procedure of producing the attachment flange, said formed portion extending beyond the stamped step.

In particular, two formed portions of the bottom panel that are provided on the respective side panel portions are folded.

The features that are described for the dishwasher cavity and the household dishwasher apply accordingly for the method and conversely.

Further possible implementations of the dishwasher cavity, of the household dishwasher and/or of the method comprise also combinations not explicitly mentioned of features or embodiments described previously or below in relation to the exemplary embodiments. In this case, the person skilled in the art will also add individual aspects as improvements or supplements to the respective basic form of the dishwasher cavity, of the household dishwasher and/or of the method.

Further advantageous embodiments and aspects of the dishwasher cavity, of the household dishwasher and/or of the method are the subject matter of the subordinate claims and also of the exemplary embodiments of the dishwasher cavity, of the household dishwasher and/or of the method that are described below. Furthermore, the dishwasher cavity, the household dishwasher and/or the method are explained in detail with the aid of the preferred embodiments with reference to the attached drawings.

DETAILED DESCRIPTION OF EXEMPLARY EMBODIMENTS OF THE PRESENT INVENTION

Figure 1:
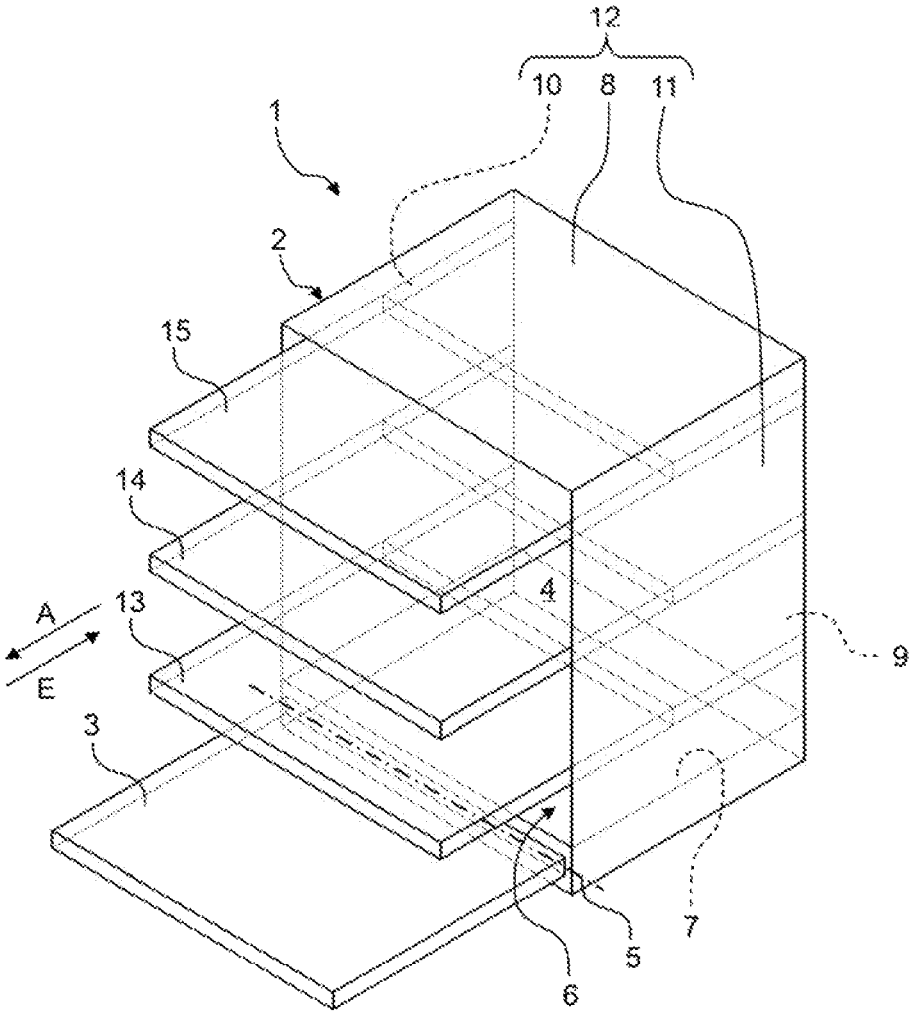
FIG. 1 shows a schematic perspective view of an embodiment of a household dishwasher.

Like or like-functioning elements are provided in the figures with the same reference numerals insofar as not otherwise stated.

FIG. 1 illustrates a schematic perspective view of a household dishwasher 1. The household dishwasher 1 comprises a dishwasher cavity 2 which may be closed by means of a door 3 in particular in a water-tight manner. For this purpose, a seal may be provided between the door 3 and the dishwasher cavity 2. The dishwasher cavity 2 may be arranged in a housing of the household dishwasher 1. The dishwasher cavity 2 and the door may form a dishwasher interior 4 for washing the items to be washed.

The door 3 is represented in FIG. 1 in its open position. The door 3 may be opened or closed by means of pivoting it about a pivot axis 5 that is provided on a lower end of the door 3. It is possible with the aid of the door 3 to close or open a loading orifice 6 of the dishwasher cavity 2. The dishwasher cavity 2 has a bottom panel 7, a top panel 8 that is arranged opposite the bottom panel 7, a back panel 9 that is arranged opposite the closed door 3 and two side panels 10, 11 that are arranged opposite one another. The bottom panel 7, the top panel 8, the back panel 9 and the side panels 10, 11 may be manufactured by way of example from a steel metal sheet. In particular, it is possible by way of example to manufacture the bottom panel 7 from a different material to that of the top panel 8 and the side panels 10, 11. By way of example, the bottom panel 7 may be manufactured from the material 1.4301, the top panel and the side panels 10, 11 from the material 1.4016 and the back panel 9 may likewise be manufactured from the material 1.4016.

A first side panel 10, a second side panel 11 and the top panel 8 that is arranged between the first side panel 10 and the second side panel 11 are configured as one part, in particular from the same material, and form a dishwasher cavity jacket 12 of the dishwasher cavity 2. The dishwasher cavity jacket 12, the back panel 9 and the bottom panel 7 are components that are manufactured separately from one another but are connected to one another in a water-tight manner. By way of example, the dishwasher cavity jacket 12 is connected to the bottom panel 7 with the aid of a folded connection, and the back panel 9 is welded, in particular spot-welded, to the dishwasher cavity jacket 12 and also to the bottom panel 7.

The household dishwasher 1 moreover has at least one device 13 to 15 for receiving the items to be washed. Multiple, by way of example three, devices 13 to 15 are preferably provided for receiving the items to be washed, wherein the device 13 for receiving the items to be washed may be a lower receiving device or a lower basket, the device 14 for receiving the items to be washed may be an upper receiving device or an upper basket and the device 15 for receiving the items to be washed may be a cutlery drawer. As further illustrated in FIG. 1, the devices 13 to 15 for receiving the items to be washed are arranged one above the other in the dishwasher cavity 2. Each device 13 to 15 for receiving the items to be washed may be slid into or out of the dishwasher cavity 2. In particular, each device 13 to 15 for receiving the items to be washed may be slid in an inward-sliding direction E (arrow) into the dishwasher cavity 2 and slid in the opposite direction to the inward-sliding direction E (arrow) in a withdrawal direction A (arrow) out of the dishwasher cavity 2.

Figure 2:
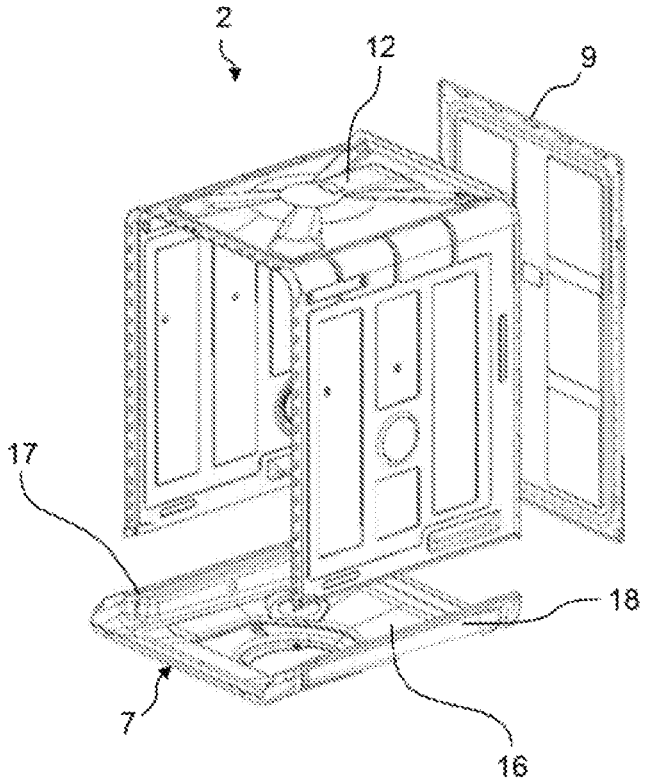
FIG. 2 shows a schematic perspective exploded view of one embodiment of a dishwasher cavity for the household dishwasher in accordance with FIG. 1.

FIG. 2 illustrates a schematic perspective exploded view of one embodiment of a dishwasher cavity 2 for the household dishwasher in accordance with FIG. 1. As illustrated in FIG. 2, the dishwasher cavity 2 comprises the in particular U-shaped dishwasher cavity jacket 12, which is arranged in a vertical position with respect to the bottom panel 7 and not in a position lying on said bottom panel, and the back panel 9. The dishwasher cavity jacket 12 is positioned in this case on the bottom panel 7 in such a manner that said dishwasher cavity jacket is open in the downward direction, in other words in the direction of the bottom panel 7 and is closed in the upward direction. The bottom panel 7 comprises a bottom portion 16 and also a first side panel portion 17 and a second side panel portion 18. The bottom portion 16 is arranged between the first side panel portion 17 and the second side panel portion 18. The side panel portions 17, 18 are arranged in particular in a vertical manner with respect to the bottom portion 16.

Figure 3:
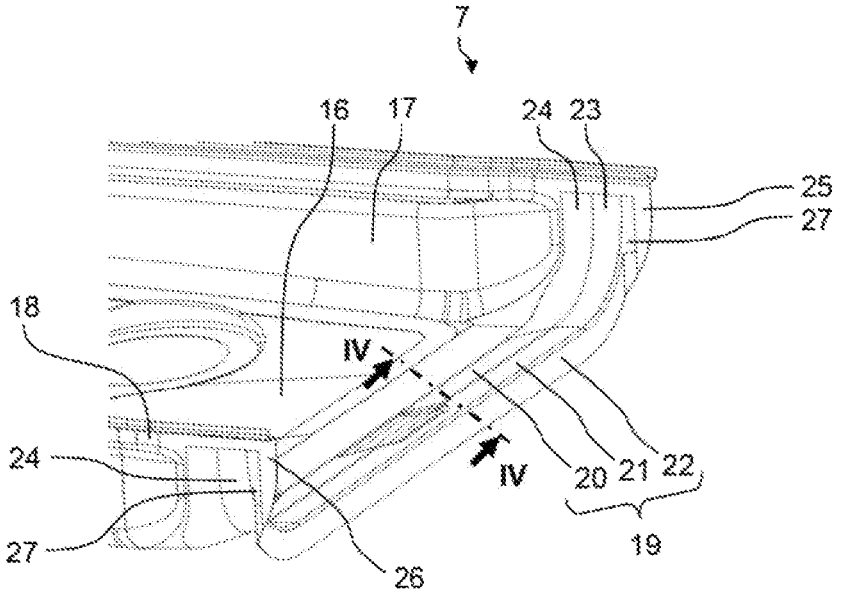
FIG. 3 shows a schematic perspective view of an embodiment of a bottom panel for the dishwasher cavity in accordance with FIG. 2.
Figure 4:
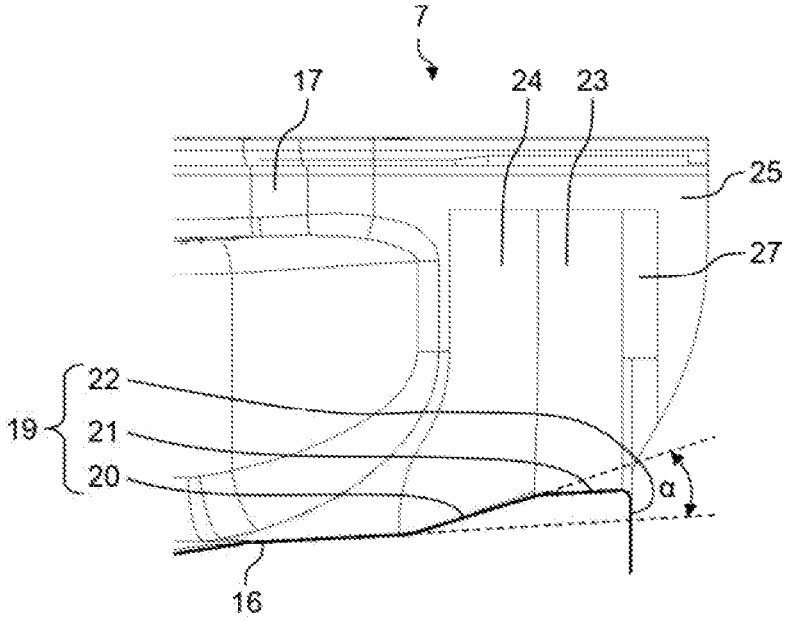
FIG. 4 shows the sectional view Iv-Iv in accordance with FIG. 3.

FIG. 3 illustrates a schematic perspective view of one embodiment of a bottom panel 7 for the dishwasher cavity 2 in accordance with FIG. 2, and FIG. 4 illustrates the sectional view Iv-Iv in accordance with FIG. 3. Reference is made below simultaneously to FIGS. 3 and 4.

The bottom panel 7 comprises a stamped step 19, which faces the direction of the top panel 8 of the dishwasher cavity jacket 12 and protrudes out of the bottom portion 16 of the bottom panel 7. The stamped step 19 comprises a first step portion 20 and also a second step portion 21. The first step portion 20 is arranged between the bottom portion 16 and the second step portion 21. The first step portion 20 is arranged at an angle of inclination a with respect to the bottom portion 16 of the bottom panel 7. The angle of inclination a may be by way of example 10 to 40°, preferably 20 to 30°, more preferably 25°.

The second step portion 21 is arranged parallel to the bottom portion 16. In other words, the bottom portion 16 and the second step portion 21 each span a plane and said planes are arranged parallel to one another and spaced apart from one another. The stamped step 19 comprises furthermore a flange portion 22 that is preferably folded in a vertical manner with respect to the second step portion 21. The second step portion 21 is arranged between the first step portion 20 and the flange portion 22.

The stamped step 19 extends on both sides with a radius 23, 24 into the side panel portions 17, 18. The first side panel portion 17 comprises a first formed portion 25 that extends beyond the stamped step 19 and may be folded in a vertical manner with respect to the first side panel portion 17 so as to form an attachment flange of the dishwasher cavity 17. However, FIG. 3 illustrates the first formed portion 25 in a non-folded state. A second formed portion 26 is allocated to the second side panel portion 18 in a similar manner. The formed portions 25, 26 respectively merge in a radius 27 into the stamped step 19, and in particular into the second step portion 21 and the flange portion 22. Prior to being folded, the formed portions 25, 26 are arranged in a vertical manner with respect to the flange portion 22. After said formed portions have been folded, they are positioned parallel to the flange portion 22.

Figure 5:
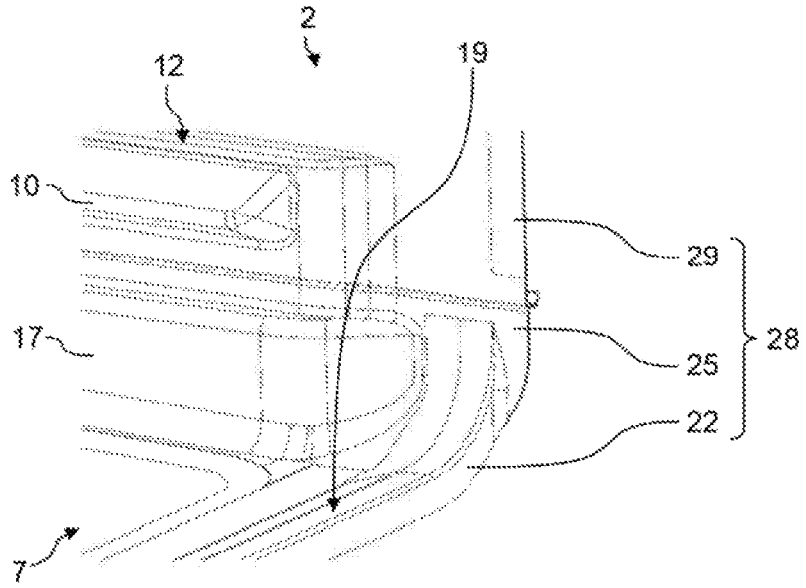
FIG. 5 shows a schematic perspective detailed view of the dishwasher cavity in accordance with FIG. 2.
Figure 6:
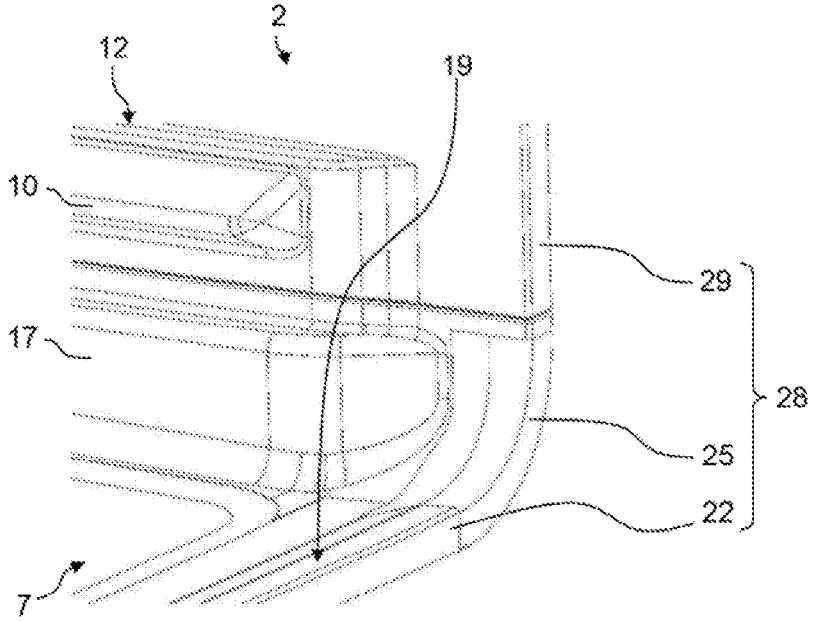
FIG. 6 shows a further schematic perspective detailed view of the dishwasher cavity in accordance with FIG. 2.

FIGS. 5 and 6 illustrate further schematic perspective views of the dishwasher cavity 2 in accordance with FIG. 2. As illustrated in FIG. 6, an attachment flange 28 that encircles the dishwasher cavity 2 so as to attach the back panel 9 to the bottom panel 7 and to the dishwasher cavity jacket 12 is provided on the bottom panel 7 and the dishwasher cavity jacket 12. The back panel 9 is in particular welded, by way of example spot-welded, to the attachment flange 18. The attachment flange 28 comprises the flange portion 22 of the stamped step 19, the formed portions 25, 26 of the bottom panel 7, which are illustrated in FIG. 5 prior to said formed portions being folded and are illustrated in FIG. 6 after said formed portions have been folded, and a flange portion 29 that is formed as one on the dishwasher cavity jacket 12. The flange portion 29 extends along the side panels 10, 11 and the top panel 8.

Figure 7:
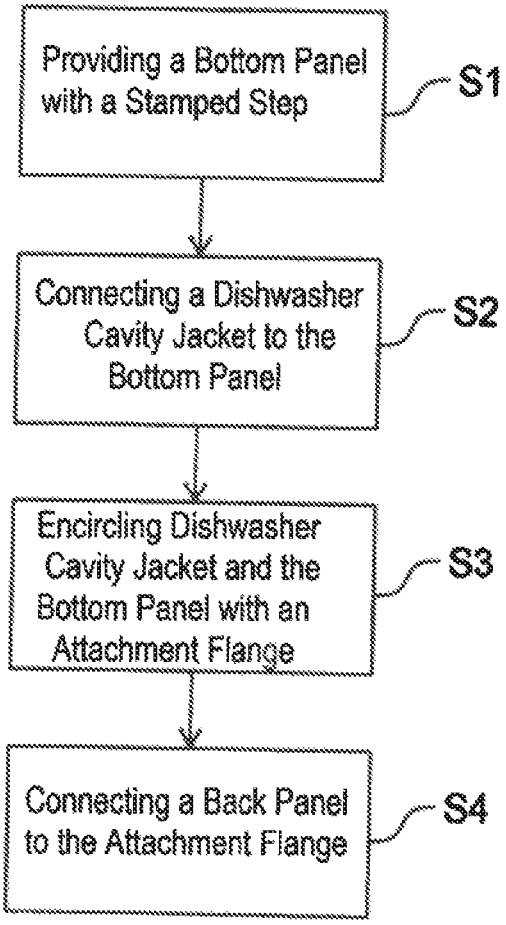
FIG. 7 shows a schematic block diagram of one embodiment of a method for producing the dishwasher cavity in accordance with FIG. 2.

FIG. 7 illustrates a schematic block diagram of a method for producing the previously explained dishwasher cavity 2. In one step S1, the bottom panel 7, the back panel 9 and the dishwasher cavity jacket 12 are provided. The bottom panel 7 comprises the stamped step 19 that protrudes out of the bottom portion 16 of said bottom panel. The stamped step 19 is impressed in the bottom panel 7 in particular already during the production stage of said bottom panel, by way of example by means of a deep-drawing procedure. In this case, the flange portion 22 is formed as one on the bottom panel 7 simultaneously during the procedure of producing said bottom panel. In a step S2, the dishwasher cavity jacket 12 is connected to the bottom panel 7. The bottom panel 7 is arranged in this case in such a manner that the stamped step 19 extends in the direction of the top panel 8 of the dishwasher cavity jacket 12. In particular, the first side panel 10 of the dishwasher cavity jacket 12 is connected to the first side panel portion 17 of the bottom panel 7 with the aid of a folded connection, and the second side panel 11 of the dishwasher cavity jacket 12 is fixedly connected to the second side panel portion 18 of the bottom panel 7 with the aid of a further folded connection.

In a step S3, the attachment flange 28 that encircles the dishwasher cavity jacket 12 and the bottom panel 7 is produced, wherein a part of the attachment flange 28 is formed by the flange portion 22 of the stamped step 19. In order to produce the attachment flange 28, the formed portions 25, 26 of the bottom panel 7 and the flange portion 29 of the dishwasher cavity jacket 12 are folded outward, in other words away from the dishwasher interior, at an angle of 90°. It is not necessary to shape the flange portion 22 of the stamped step 19 during the procedure of producing the attachment flange 28 since said flange portion is already formed at 90° relative to the second step portion 21. In a step S4, the back panel 9 is connected to the attachment flange 28. For this purpose, the back panel 9 is by way of example welded to the attachment flange 28.

The additional stamped step 19 makes it possible to pre-fabricate the geometric shape of the attachment flange 28 in a precise manner directly in the tool used for producing the bottom panel 7. In other words, prior to connecting the dishwasher cavity jacket 12 to the bottom panel 7, a part of the attachment flange 28, namely the flange portion 22 of the stamped step 19, is configured as a flat continuous contour and folded in the later step S3 to form the continuous attachment flange 28 that is folded by 90°. The attachment flange 28 may thus be produced without corrugations or irregularities. The stamped step 19 extends in this case with the radii 23, 24 into the respective side panel portion 17, 18 and consequently forms a preliminary step of the later intended final contour as far as the fold region with an improved quality.

It is in addition made possible to reinforce the bottom panel 7 in the region of the attachment flange 28 by means of the stamped step 19 that is continuously impressed over the entire width of the bottom panel and the subsequent quality of the sealing arrangement between the back panel 9 and the attachment flange 28 is improved in this case by means of the additionally achieved rigidity or form stability.

In addition, the elevated level of the attachment flange 28 in comparison to the bottom portion 16 of the bottom panel 7 makes possible an improved drainage function of the washing water in the direction of a pump system or filter system since said attachment flange 28 forms a downward-extending inclined plane in the form of the first step portion 20. The resulting improved re-circulation leads to a more favorable circulating function of the hydraulic pump system during the washing procedure. Since the stamped step 19 extends upward in the direction of the top panel 8, the back panel 9 may be configured to be shorter.

Although the present invention has been described with the aid of exemplary embodiments, said invention may be modified in numerous ways.

The invention claimed is:

1. A dishwasher cavity for a household dishwasher, said dishwasher cavity comprising:

a bottom panel having a bottom portion;

a U-shaped dishwasher cavity jacket arranged on the bottom panel and fixedly connected thereto, the bottom panel and the dishwasher cavity jacket configured to form an attachment flange that encircles the dishwasher cavity; and a back panel attached to the bottom panel and to the dishwasher cavity jacket via the attachment flange, wherein the bottom panel comprises a stamped step, which faces in a direction of a top panel of the dishwasher cavity jacket and protrudes out of the bottom portion of the bottom panel, with the attachment flange having a part formed on the stamped step, wherein the stamped step is sized to extend with a radius into a side panel portion of the bottom panel.

2. The dishwasher cavity of claim 1, wherein the stamped step comprises a first step portion, which is arranged at an angle of inclination with respect to the bottom portion of the bottom panel, and a second step portion, which is arranged parallel to the bottom portion of the bottom panel, with the first step portion being arranged between the bottom portion and the second step portion.

3. The dishwasher cavity of claim 1 wherein the side panel portion of the bottom panel comprises a formed portion sized to extend beyond the stamped step and foldable such as to form the attachment flange.

4. The dishwasher cavity of claim 3, wherein prior to the formed portion being folded, said formed portion is arranged in a vertical manner with respect to the part of the attachment flange formed on the stamped step.

5. The dishwasher cavity of claim 3, wherein the formed portion extends parallel to the part of the attachment flange formed on the stamped step.

6. The dishwasher cavity of claim 1, wherein the bottom panel comprises a first side panel portion and a second side panel portion, said bottom portion of the bottom panel being arranged between the first side panel portion and the second side panel portion.

7. The dishwasher cavity of claim 1, wherein the dishwasher cavity jacket comprises a first side panel fixedly connected to the bottom panel, and a second side panel fixedly connected to the bottom panel, said top panel of the dishwasher cavity jacket being arranged between the first side panel and the second side panel.

8. The dishwasher cavity of claim 1, wherein the attachment flange extends in a vertical manner with respect to the dishwasher cavity jacket and the bottom portion of the bottom panel.

9. The dishwasher cavity of claim 1, wherein the back panel is welded to the attachment flange.

10. The dishwasher cavity of claim 1, wherein the back panel is spot-welded to the attachment flange.

11. A household dishwasher, comprising a dishwasher cavity, said dishwasher cavity comprising:

a bottom panel having a bottom portion;

a U-shaped dishwasher cavity jacket arranged on the bottom panel and fixedly connected thereto, the bottom panel and the dishwasher cavity jacket configured to form an attachment flange that encircles the dishwasher cavity; and a back panel attached to the bottom panel and to the dishwasher cavity jacket via the attachment flange, wherein the bottom panel comprises a stamped step, which faces in a direction of a top panel of the dishwasher cavity jacket and protrudes out of the bottom portion of the bottom panel, with the attachment flange having a part formed on the stamped step, wherein the stamped step is sized to extend with a radius into a side panel portion of the bottom panel.

12. A method for producing a dishwasher cavity for a household dishwasher, said method comprising:

forming a stamped step in a bottom panel such as to protrude from a bottom portion of the bottom panel, the stamped step extending with a radius into a side panel portion of the bottom panel;

connecting a U-shaped dishwasher cavity jacket to the bottom panel in such a manner that the stamped step extends in a direction of a top panel of the dishwasher cavity jacket;

encircling the dishwasher cavity jacket and the bottom panel by an attachment flange, with a part of the attachment flange being formed by the stamped step; and connecting a back panel to the attachment flange.

13. The method of claim 12, wherein the stamped step is formed together with the part of the attachment flange during production of the bottom panel.

14. The method of claim 12, further comprising producing the attachment flange by forming the side panel portion of the bottom panel with a formed portion that extends beyond the stamped step, and folding the formed portion of the side panel portion.

15. The method of claim 14, wherein the formed portion, before being folded, extends in a vertical manner with respect to the stamped step forming part of the attachment flange.

16. The method of claim 14, wherein the formed portion, after being folded, extends parallel to the part of the stamped step forming part of the attachment flange.

17. The method of claim 14, wherein the formed portion to form the attachment flange is folded in a vertical manner with respect to the dishwasher cavity jacket and the bottom portion of the bottom panel.

* * * * *